US008038287B2

(12) United States Patent
Shiohara

(10) Patent No.: US 8,038,287 B2
(45) Date of Patent: Oct. 18, 2011

(54) IMAGE RECORDING DEVICES

(75) Inventor: Yukio Shiohara, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 635 days.

(21) Appl. No.: 12/031,190

(22) Filed: Feb. 14, 2008

(65) Prior Publication Data

US 2008/0239046 A1 Oct. 2, 2008

(30) Foreign Application Priority Data

Mar. 26, 2007 (JP) ..... 2007-080139

(51) Int. Cl.
*B41J 2/01* (2006.01)

(52) U.S. Cl. ..... 347/104; 271/258.01

(58) Field of Classification Search ..... 347/101; 271/234–240

See application file for complete search history.

(56) References Cited

U.S. PATENT DOCUMENTS

| | | | | |
|---|---|---|---|---|
| 4,437,780 | A * | 3/1984 | Weber et al. | 400/642 |
| 4,583,873 | A * | 4/1986 | Parks et al. | 400/629 |
| 5,201,873 | A * | 4/1993 | Kikuchi et al. | 271/9.13 |
| 5,800,076 | A * | 9/1998 | Umeda | 400/645.3 |
| 5,850,246 | A * | 12/1998 | Maslanka et al. | 347/197 |
| 5,923,438 | A * | 7/1999 | Fujiwara | 358/401 |
| 6,185,405 | B1 * | 2/2001 | Sueoka | 399/367 |
| 2001/0017438 | A1 * | 8/2001 | Takamtsu | 271/3.14 |
| 2005/0129440 | A1 * | 6/2005 | Nagata et al. | 399/405 |
| 2005/0196216 | A1 | 9/2005 | Tanahashi et al. | |
| 2006/0012105 | A1 * | 1/2006 | Shiohara et al. | 271/10.01 |
| 2006/0221165 | A1 * | 10/2006 | Kato | 347/104 |
| 2007/0075484 | A1 * | 4/2007 | Terada | 271/258.01 |
| 2007/0146463 | A1 * | 6/2007 | Sasa | 347/104 |
| 2007/0164498 | A1 * | 7/2007 | Watanabe | 271/3.14 |

FOREIGN PATENT DOCUMENTS

| | | | |
|---|---|---|---|
| JP | 2002148879 | A | 5/2002 |
| JP | 2004354422 | A | 12/2004 |
| JP | 2005247544 | A | 9/2005 |

* cited by examiner

*Primary Examiner* — Charlie Peng
*Assistant Examiner* — Peter Radkowski
(74) *Attorney, Agent, or Firm* — Baker Botts L.L.P.

(57) ABSTRACT

An image recording device includes a conveying roller which extends in an axial direction, and a guide member which extends in the axial direction and is configured to guide a recording medium toward the conveying roller. The guide member includes a first end portion, a second end portion, and a middle portion positioned between the first end portion and the second end portion in the axial direction. The device also includes a supporting member which extends in the axial direction and is separated from the conveying roller by a predetermined distance. Moreover, the first end portion and the second end portion are in a fixed position with respect to the conveying roller, and the middle portion is in a fixed position with respect to the supporting member.

18 Claims, 9 Drawing Sheets

IMAGE RECORDING DEVICES

CROSS-REFERENCE TO RELATED APPLICATION

The present application claims priority from Japanese Patent Application Publication No. JP-2007-080139, which was filed on Mar. 26, 2007, the disclosure of which is incorporated herein by reference in its entirety.

BACKGROUND OF THE INVENTION

1. Field of the Invention

The present application relates generally to an image recording device which records an image on a recording medium conveyed by a roller. In particular, the present invention is directed towards an image recording device comprising a guide member which guides a recording medium to the roller.

2. Description of Related Art

A known image recording device, a printer, such as the image recording device disclosed in Japanese Laid-Open Patent Application No. 2005-247544, includes a conveying device which conveys a recording medium along a U-shaped conveying path. In the known image recording device, sheets of recording medium are stacked on a sheet cassette and are conveyed upward along a guide member, which defines the U-shaped conveying path, to an inkjet type recording unit.

The guide member guides a sheet to a conveying roller which performs sheet registration by correcting the skew of the sheet and positioning a lead edge of the sheet. Accurately positioning the sheet at the conveying roller is important for ensuring sheet registration and for preventing sheet jamming. Therefore, the guide member includes C-shaped hooks at both ends thereof, and the hooks are fitted around a shaft of the conveying roller. This improves the accuracy of fixing the position of the guide member with respect to the conveying roller.

The conveying roller is cylindrical and has a circular cross-section having a constant diameter when cut at any position thereof in a direction perpendicular to the longitudinal direction. The conveying roller extends over the sheet width, and the guide member is fitted around the both ends of the conveying roller which do not contact the sheet to be conveyed. Nevertheless, when the guide member has a relatively large width corresponding to the width of a sheet to be conveyed, and the guide member comprises a synthetic resin, the guide member is likely to bend in the width direction during operation. Consequently, during operation, the middle portion of the guide member does not maintain a fixed position with respect to the conveying roller. When the guide member conveys a sheet, the bending of the guide member may cause the position at which the middle portion of the sheet contacts the conveying roller to vary, thereby resulting in faulty sheet registration or sheet jamming.

SUMMARY OF THE INVENTION

Therefore, a need has arisen for image recording devices which overcome these and other shortcoming of the present invention. A technical advantage of the present invention is that a guide member is configured to guide and position a recording medium accurately with respect to the conveying roller.

According to an embodiment of the present invention, an image recording device comprises a conveying roller which extends in an axial direction, and a particular guide member which extends in the axial direction and is configured to guide a recording medium toward the conveying roller. The particular guide member includes a first end portion, a second end portion, and a middle portion positioned between the first end portion and the second end portion in the axial direction. The device also comprises a supporting member which extends in the axial direction and is separated from the conveying roller by a predetermined distance. Moreover, the first end portion and the second end portion are in a fixed position with respect to the conveying roller, and the middle portion is in a fixed position with respect to the supporting member.

Other objects, features, and advantages will be apparent to persons of ordinary skill in the art from the following detailed description of the invention and the accompanying drawings.

BRIEF DESCRIPTION OF THE DRAWINGS

For a more complete understanding of the present invention, the needs satisfied thereby, and the features and technical advantages thereof, reference now is made to the following descriptions taken in connection with the accompanying drawings.

DETAILED DESCRIPTION OF THE EMBODIMENTS

Embodiments of the present invention and their features and technical advantages may be understood by referring to FIGS. 1-9, like numerals being used for like corresponding parts in the various drawings.

Figure 1:
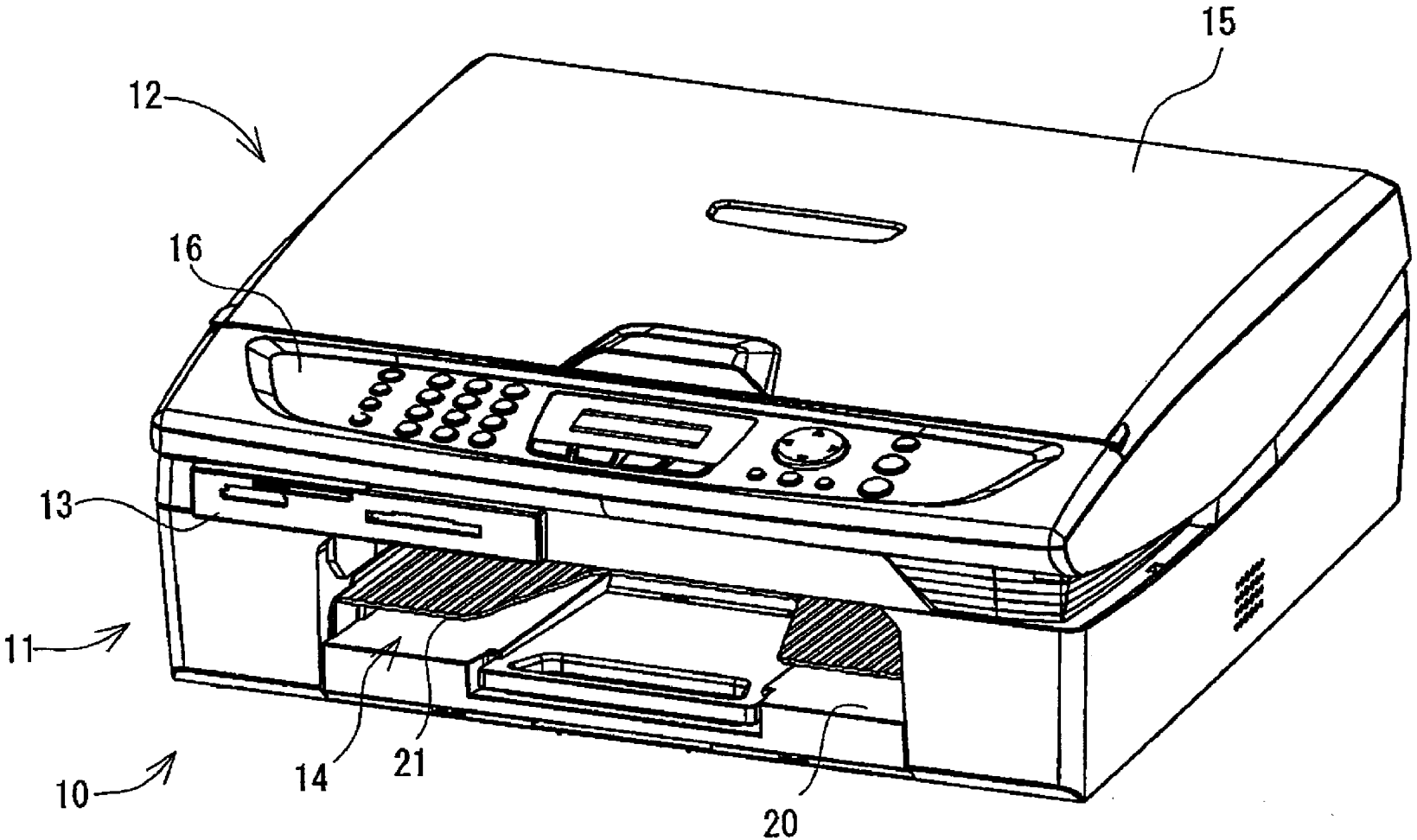
FIG. 1 is an external view of an image recording device, such as a multi-function device, according to an embodiment of the present invention.
Figure 2:
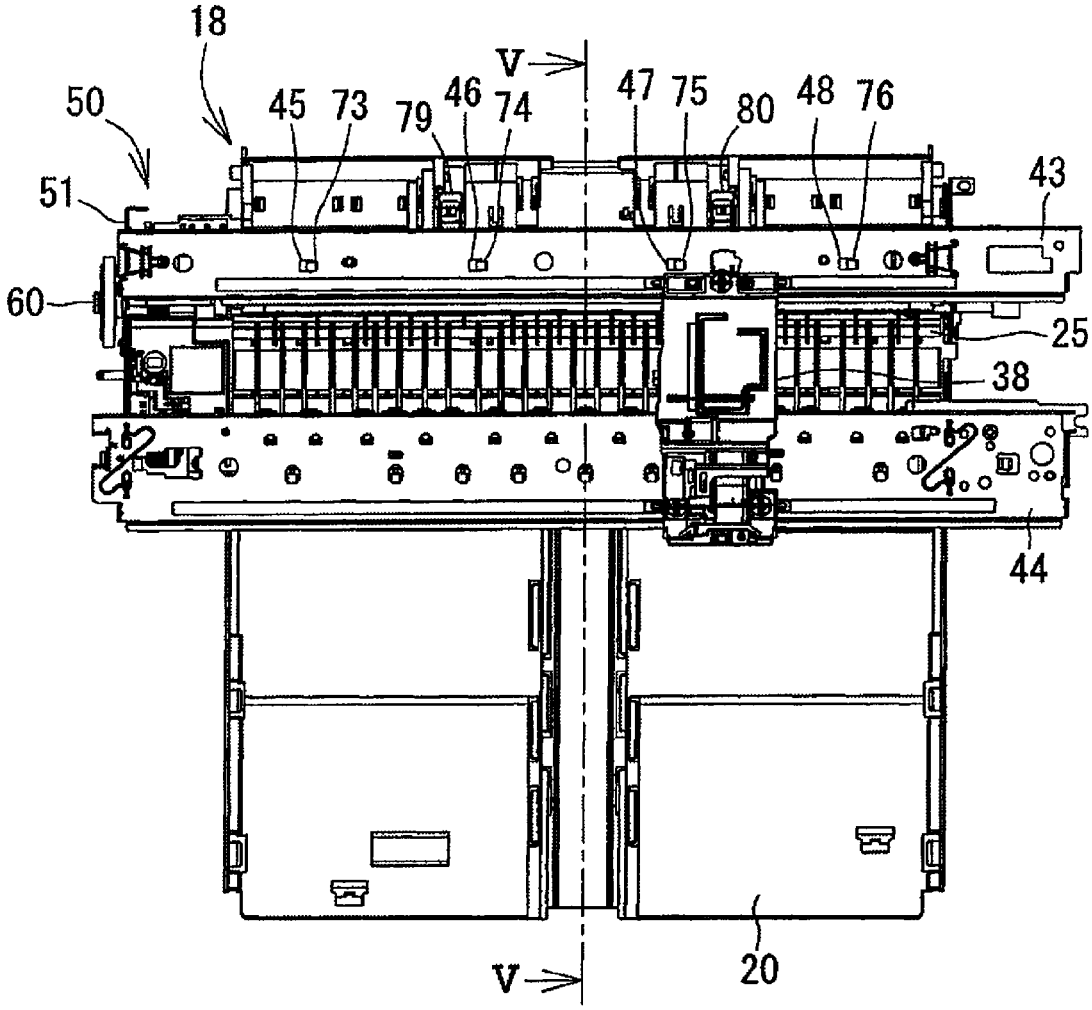
FIG. 2 is a plan view of a recording unit.

Referring to FIG. 1, an image recording device, such as a multi-function device 10, may comprise a printer 11 at a lower portion thereof, and a scanner 12 at an upper portion thereof. The multi-function device 10 may perform at least one function, a plurality of functions, such as printing, copying, scanning, or facsimile functions, or any combination thereof.

The printer 11 may be connected to an external device, such as a computer, and may be configured to record an image, text or the like, on a recording medium based on image data transmitted from the external device.

The printer 11 also may be connected to a digital camera and may record image data outputted from the digital camera onto a recording medium, or may record image data stored in a memory medium, a memory card, on a recording medium.

The multi-function device 10 may have a box shape, and have a width and a depth which are greater than a height of the multi-function device 10. The printer 11 may have an opening at a front of the multi-function device 10. A sheet tray 20 and a discharge tray 21 positioned above the sheet tray 20 may be provided inside the opening 14. Recording medium, such as sheets of paper, A4 size paper, B5 size paper, postcard size paper, or the like are stacked on the sheet tray 20. A sheet on the sheet tray 20 is conveyed to the printer 1, and the sheet on which an image has been recorded is discharged onto the discharge tray 21. The recording medium may be sheets comprising a synthetic resin or other materials.

A scanner 12, a flat bed scanner, may be positioned at an upper portion of the multi-function device 10. A platen glass (not shown) and an image sensor (not shown) may be positioned below a document cover. The document cover may be configured to be selectively opened and closed, and may be a top plate of the multi-function device 10. The image sensor scans a document positioned on the platen glass.

An operation panel 16 for the printer 11 and the scanner 12 may be positioned at an upper, front portion of the multi-function device 10. The operation panel 16 comprises operation buttons and a liquid crystal display. The multi-function device 10 operates based on instructions received via the operation panel 10, or instructions received from a computer connected to the multi-function device 10 via a printer driver or a scanner driver.

Referring to FIGS. 2-5, the sheet tray 20 may be positioned at a bottom portion of the printer 11. An inclined separation plate 22 may be positioned at a deep end of the sheet tray 20. Lead edges of sheets fed from the sheet tray 20 contact the inclined separation plate 22, and an uppermost sheet is separated by separation claws of the inclined separation plate 22.

A conveying path 23, a U-shaped conveying path, may be formed above the inclined separation plate 22. The conveying path 23 extends upward from the inclined separation plate 22 and bends toward the front (right in FIG. 5) of the multi-function device 10. A recording unit 24 may be positioned above the conveying path 23. A platen 25 may be positioned along the conveying path 23 to face the recording unit 24. A sheet on the sheet tray 20 is guided upward, turned around along the conveying path, and subsequently reaches the platen 25. The recording unit 24 then records an image onto the sheet on the platen 25, and the sheet then is discharged from the conveying path 23 onto the discharge tray 21.

A shaft 26 may be positioned below the platen 25. The shaft 26 may be a pivot of a pivotable sheet feeder (not shown). The sheet feeder may comprise an arm pivotable about the shaft 26, and a sheet feed roller positioned at a pivotable end of the arm. The arm pivots vertically according to the number of sheets stored in the sheet tray 20. The sheet feed roller is driven to rotate by a motor or the like, thereby feeding a sheet in the sheet tray 20 to the conveying path 23 via the inclined separation plate.

The conveying path 23 may comprise a first guide member 17, a second guide member 18, and a third guide member 19 that are arranged at predetermined intervals to face each other. The conveying path 23 may comprise a bent portion extending from the inclined separation plate 22 to the platen 25.

A recording head 39, an ink jet recording head, may be mounted on a carriage 38. The carriage 38 may be configured to reciprocate in a main scanning direction, which is perpendicular to a sheet conveying direction. Cyan, magenta, yellow, and black ink may be supplied from ink cartridges (not shown), which are positioned separately from the recording head 39, to the recording head 39 through ink tubes (not shown). While the carriage reciprocates, the recording head ejects droplets of ink to record an image on a sheet conveyed over the platen.

A pair of guide plates 43 and 44 may be positioned to face the platen 25. The guide plates 43 and 44 are separated from each other by a predetermined distance in the sheet conveying direction (top-bottom direction in FIG. 2) and extend horizontally in a direction perpendicular to the sheet conveying direction. The guide plates 43 and 44 may be positioned in a housing of the printer 11, and may comprise a portion of a frame which supports various components of the printer 11. The carriage 38 slides over the guide plates 43 and 44 in the main scanning direction, and the guide plate 43 positioned upstream in the sheet conveying direction is configured to support the first guide member.

Each of the guide plates 43 and 44 may be a flat plate having a length in its longitudinal direction which is longer than the carriage reciprocating range. The guide plates 43 and 44 are rigid enough to support the carriage 38, such that the carriage 38 slides on the guide plates 43 and 44 horizontally with precision. The guide plates 43 and 44 may comprise aluminum alloys or other nonferrous metals, or steel materials.

Four holes 45-48 may be formed in the guide plate 43 at predetermined intervals in the longitudinal direction of the guide plate 43. The holes 45-48 may be rectangular and substantially identical. The holes 45-48 may be used to position the middle portion of the first guide 17 at the guide plate 43.

A belt driving mechanism (not shown) for reciprocating the carriage 48 may be positioned on the guide plates 44.

Figure 3:
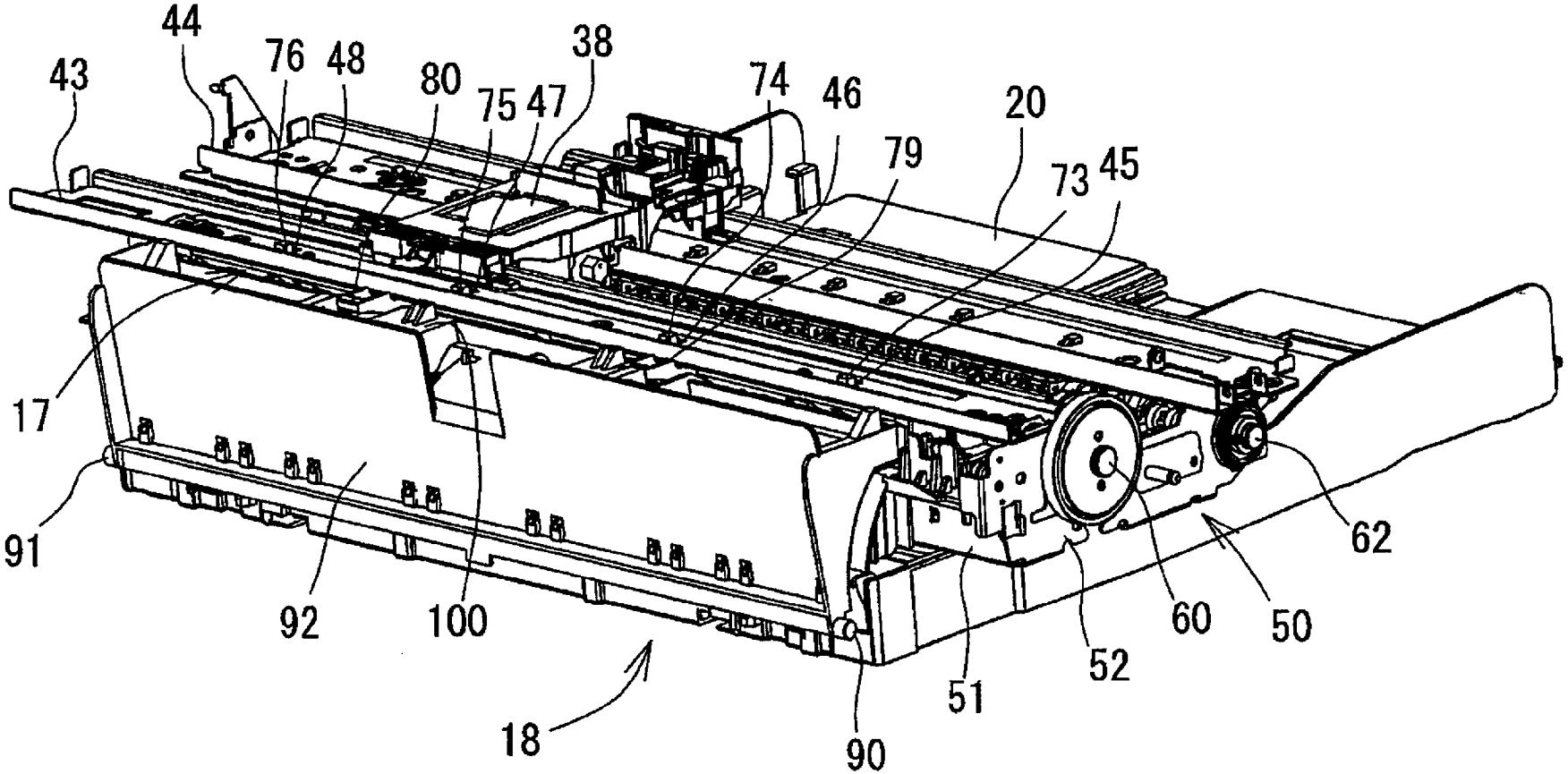
FIG. 3 is a perspective view of the recording unit as viewed from the rear of the image recording device of FIG. 1.
Figure 4:
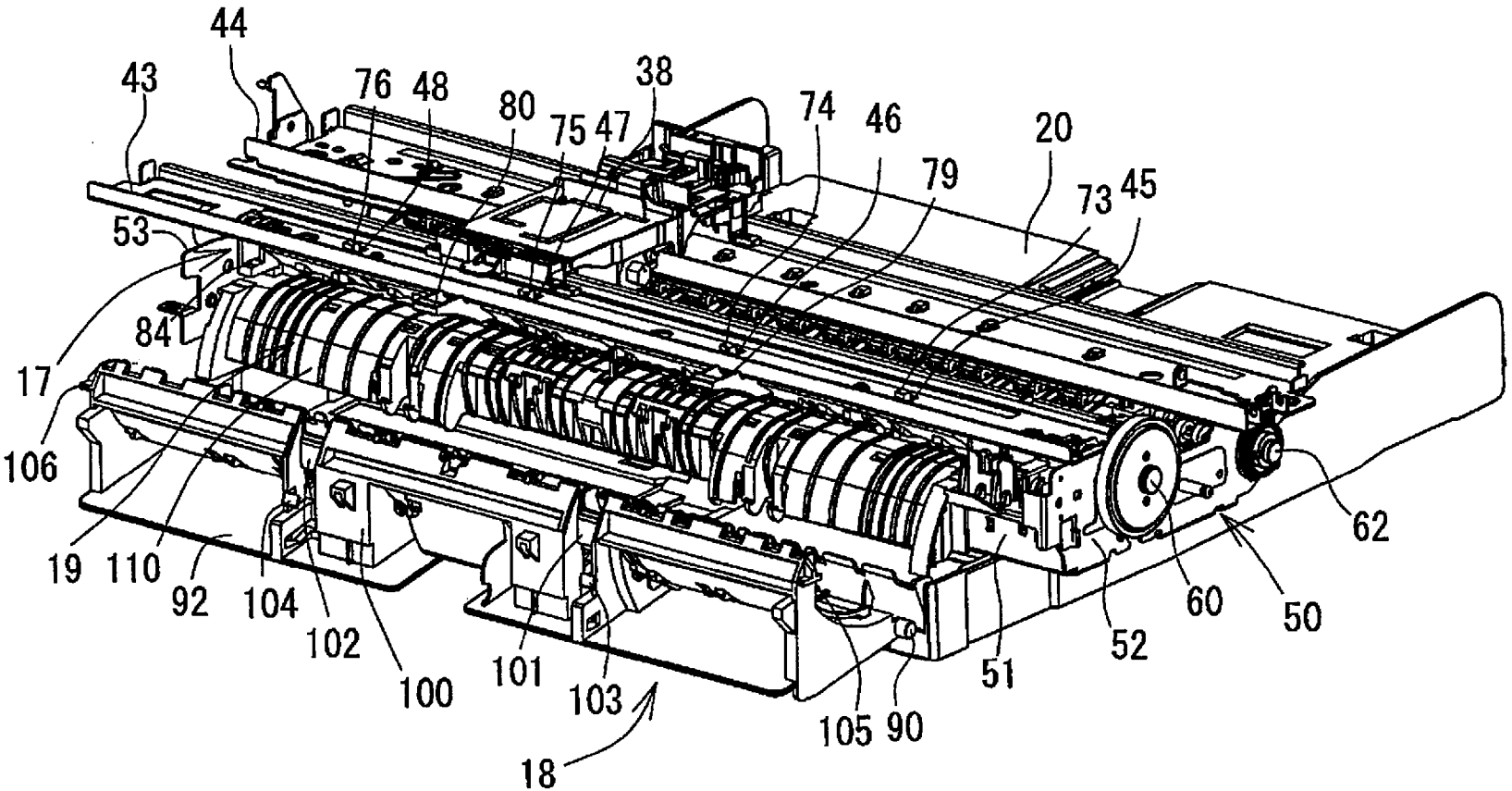
FIG. 4 is a perspective view of the recording unit as viewed from the rear of the image recording device of FIG. 1.

Referring to FIGS. 3 and 4, a frame 50 may comprise the guide plates 43 and 44, and a frame body 51. The frame body 51 may be shaped like a box open upward. The frame body 51 has a predetermined rigidity, and may comprise aluminum alloys or other nonferrous metals, or steel materials. The platen 25, a conveying roller 60, and a discharge roller 62 may be mounted to the frame body 51. The platen 25 may be fixed to the frame body 51, such that the longitudinal direction of the platen 25 is parallel to the longitudinal direction of the frame body 51.

The frame body 51 may comprise end plates 52 and 53 at both ends in its longitudinal direction. The end plates 52 and 53 are vertical walls which may extend from both ends of the frame body 51, and may be integral with the frame body 51. The guide plates 43 and 44 may be assembled to the end plates 52 and 53, such that upper surfaces of the guide plates 43 and 44 are horizontal.

Figure 6:
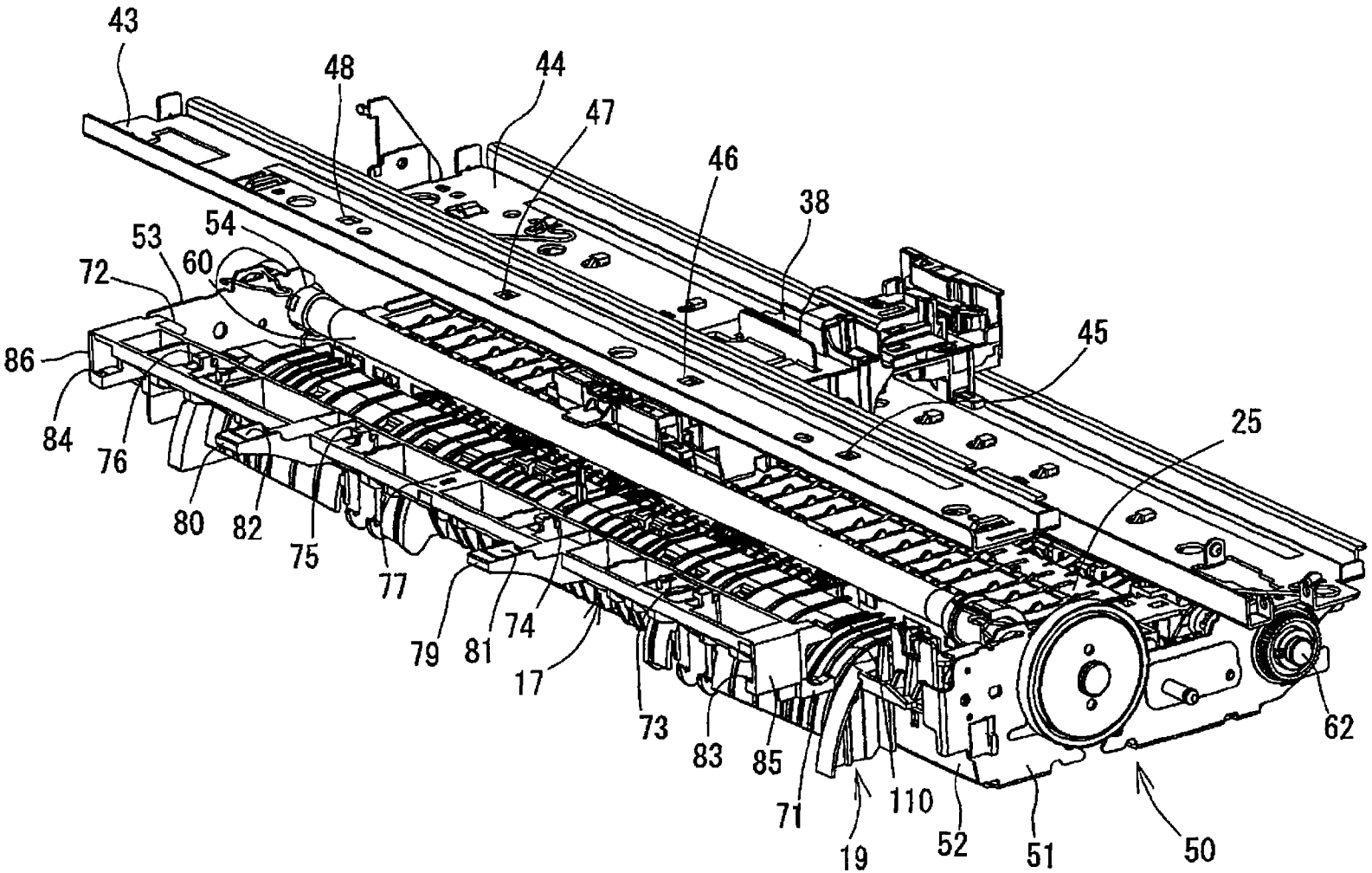
FIG. 6 is a perspective view of the recording unit with a guide plate and a first guide member removed.

Two pairs of recesses may be formed at predetermined positions of the end plates 52 and 53 to receive two pairs of bearings 54 (only one bearing 54 is shown in FIG. 6). The bearings 54 are fitted freely around the ends of the conveying roller 60 and the discharge roller 62. The conveying roller 60 and the discharge roller 62 are rotatably fixed to the predetermined positions of the end plates 52 and 53 when the bearings 54 are fixed to the recesses. The conveying roller 60 and the discharge roller 62 may be positioned upstream and downstream in the sheet conveying direction, respectively.

Figure 5:
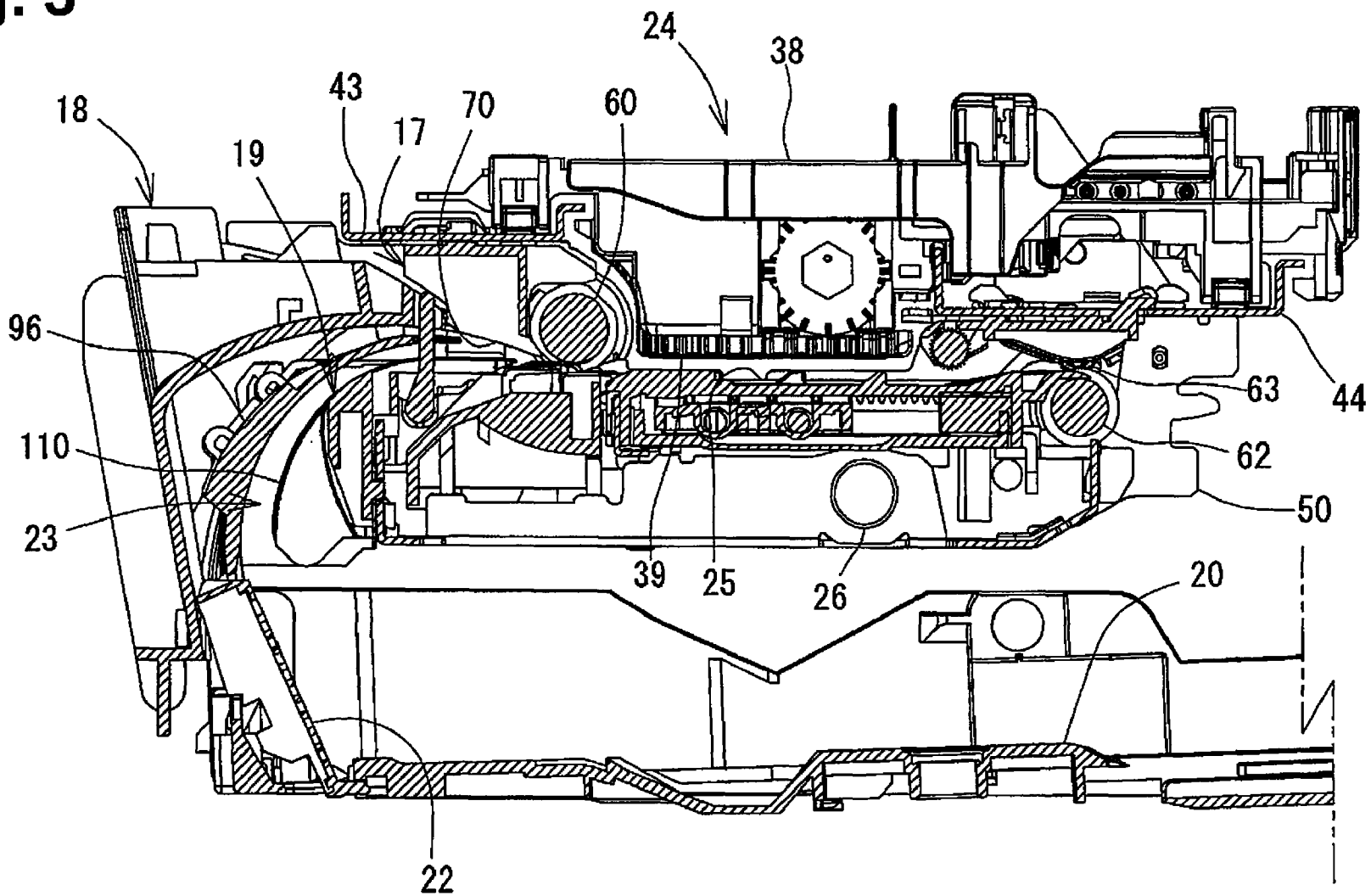
FIG. 5 is an enlarged, sectional view taken along line V-V in FIG. 2.

As shown in FIG. 5, the conveying roller 60 and a pinch roller (not shown) may be provided upstream of the recording unit 24. The conveying roller 60 performs sheet registration by correcting the skew of the sheet and by positioning a lead edge of the sheet. The pinch roller may be pressed against the conveying roller 60 from below. The axial direction of the conveying roller 60 may be parallel to the longitudinal direction of the guide plate 43. The straightness of the conveying roller 60 in its axial direction is maintained. Thus, the distance between the guide plate 43 and the conveying roller 60 is maintained constant. The carriage 38 may be guided by the guide plates 43 and 44, and may reciprocate on the guide plates 43 and 44 in the axial direction of the conveying roller 60.

The discharge roller 62 and a spur roller 63 may be positioned downstream of the recording unit 24 so as to pinch and discharge a sheet having an image formed thereon onto the discharge tray 21. In FIG. 5, only a portion of the spur roller 63 is shown. The spur roller 63 may be pressed against the discharge roller 62 from above. The conveying roller 60 and the discharge roller 62 may be rotated by a driving force transmitted from a motor, and may feed a sheet a predetermined distance when the carriage is not moving, when the recording head 39 is not recording. The conveying roller 62 and the discharge roller 62 may rotate synchronously.

As shown in FIG. 5, the first guide member 17 and the second guide 18 may be positioned outside the bent portion of the conveying path 23, and the third guide member 19 may be positioned inside the bent portion. The first guide member 17, the second guide member 18, and the third guide 19 may comprise the conveying part 23. The first guide member 17 may be positioned downstream of the second guide member 18 in the sheet conveying direction. The first guide member 17 guides a sheet to a predetermined position of the conveying roller 60.

Figure 7:
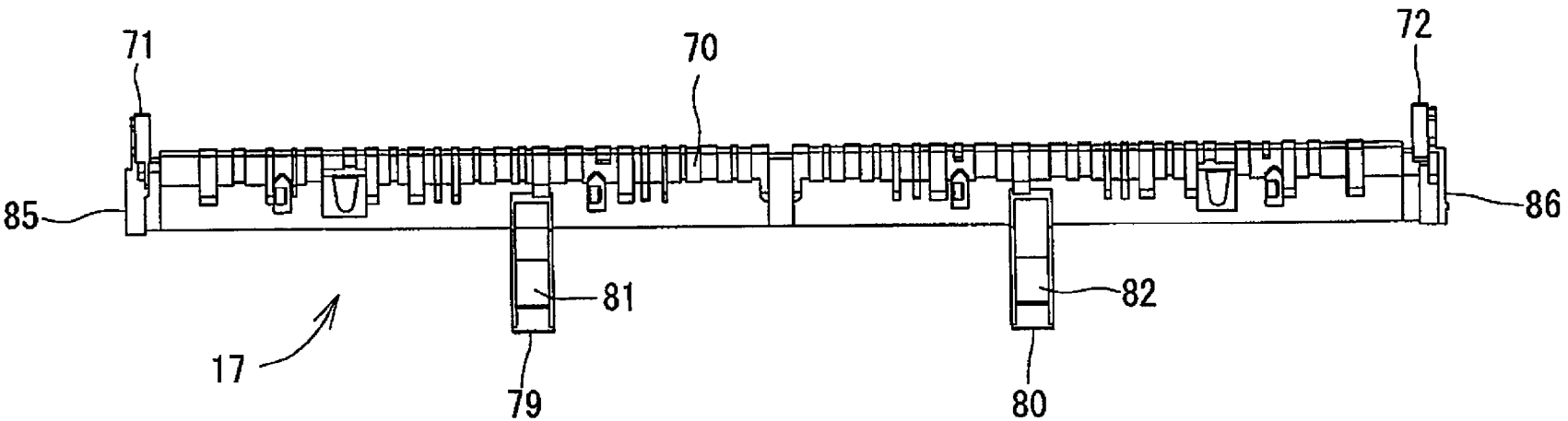
FIG. 7 is a bottom view of a first guide member.

As shown in FIG. 6, the first guide member 17 may be an elongated member extending in an axial direction of the conveying roller 60. The longitudinal direction of the first guide member 17 may be parallel to the axial direction of the conveying roller 60. As shown in FIG. 7, a guide surface 70 for guiding the sheet may be positioned at a downstream portion (top portion in FIG. 7) of a bottom surface of the first guide member 17. Ribs extending in the sheet conveying direction may be formed on the guide surface 70 at predetermined intervals in the longitudinal direction of the first guide member 17. The ribs reduce friction between the guide surface 70 and the sheet.

A pair of C-shaped hooks 71 and 72 may be positioned at the longitudinal ends of the first guide member 17. The hooks 71 and 72 are open toward the downstream direction in the sheet conveying direction. The opening becomes wider toward the upstream direction. The hooks 71 and 72 pinch the bearings 54 which are fitted freely around the both ends of the conveying roller 60. The bearings 54 are pushed into the hooks 71 and 72 while the openings of the hooks 71 and 72 are elastically enlarged. When the bearings 54 are fully pushed into the hooks 71 and 72, the hooks 71 and 72 return to the original state and pinch the bearings 54. In this state, the conveying roller 60 is allowed to rotate. In this way, the position of the first guide member 17 is fixed with respect to both ends of the conveying roller 60 in a vertical direction and in the sheet conveying direction.

As shown in FIG. 6, four engaging hooks 73-76 may be positioned on an upper surface 77 of the first guide member 17. The engaging hooks 73-76 extend upright from the upper surface 77. The hooks 73-76 are inserted into the holes 45-48 of the guide plate 43, respectively. The engaging hooks 73-76 may be positioned on the upper surface 77 at positions corresponding to the holes 45-48 of the guide plate 43, respectively. At these positions, the first guide member 17 is coupled to the guide plate 43. Each of the engaging hooks 73-76 is shaped like a hook which extends upright from the upper surface 77 and is bent horizontally. Each of the engaging hooks 73-76 is configured to be inserted into a corresponding one of the holes 45-48, and engages the upper surface because of its hooked shape. The first guide member 17 is coupled to the guide plate 43 by the engagement of the engaging hooks 73-76 with the guide plate 43.

Figure 8:
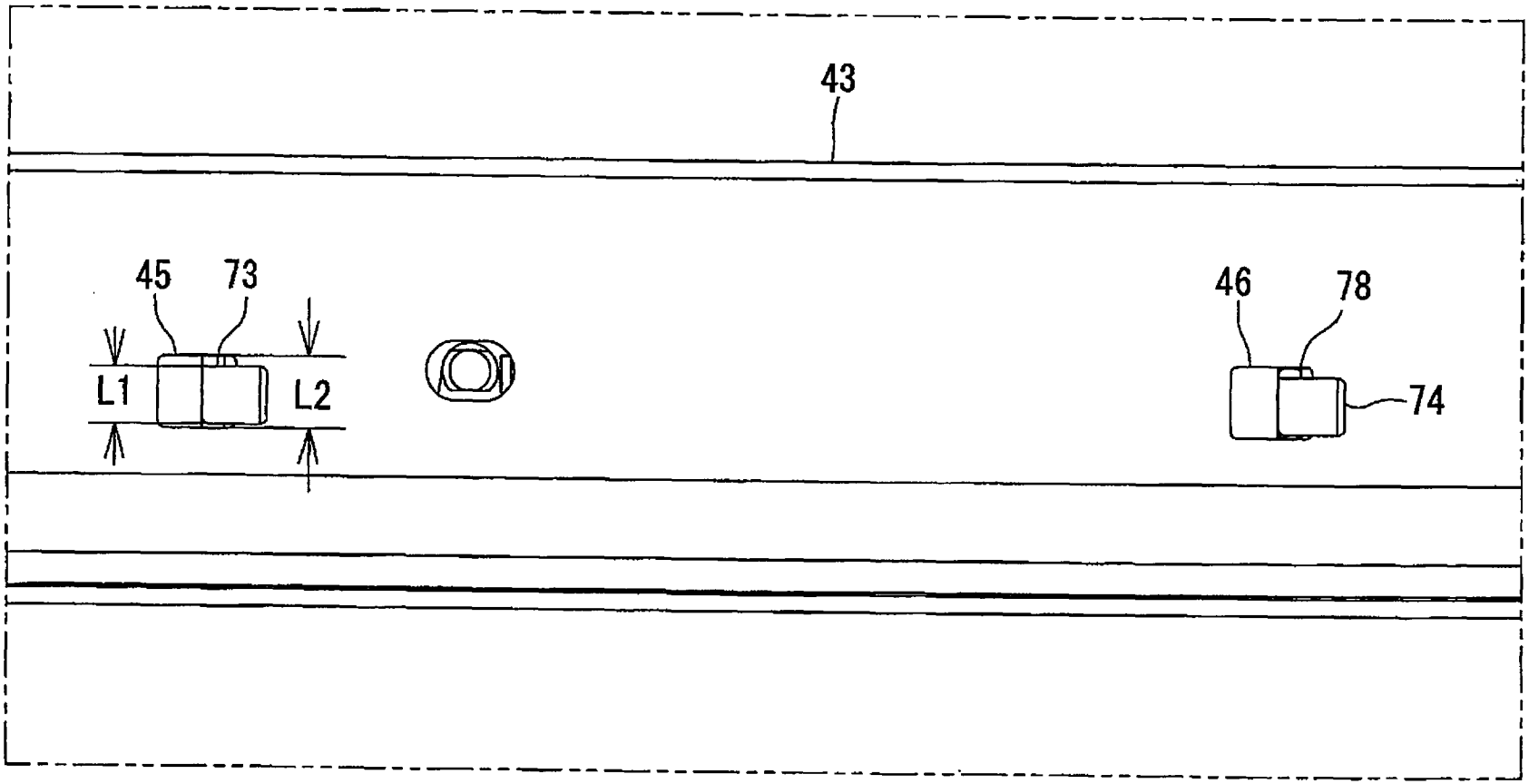
FIG. 8 is an enlarged, plan view showing an engaging state of engaging hooks and holes.

FIG. 8 shows the engagement between the engaging hooks 73 and 74 and the holes 45 and 46, respectively, and the engagement between the engaging hooks 76 and 75 and the holes 48 and 47, respectively, is substantially the same as the engagement between the engaging hooks 73 and 74 and the holes 45 and 46, respectively. Specifically, the engaging hooks 73 and 76 which are positioned adjacent to the respective ends of the first guide member 17 in the longitudinal direction are configured to engage the holes 45 and 48, respectively, and may move slightly within holes 45 and 48, respectively. In contrast, the engaging hooks 74 and 75 which are located adjacent to the center of the first guide member 17 in the longitudinal direction engage the holes 46 and 47, respectively, and are fixed within the holes 46 and 47, respectively.

More specifically, a length L1 of the engaging hook 73 in the sheet conveying direction (up-down direction in FIG. 8) may be less than a length L2 of the hole 45. Thus, the engaging hook 73, when engaged in the hole 45, may move a distance corresponding to a difference between L2 and L1 in the sheet conveying direction. In contrast, a length of the engaging hook 74 in the sheet conveying direction is substantially the same as a length of the hole 46 in the sheet conveying direction. The engaging hook 74 has a protrusion 78 projecting from a side wall thereof toward the upstream direction (upward in FIG. 8) in the sheet conveying direction. The projecting dimension of the protrusion 78 is substantially equal to the difference between L2 and L1, or may be slightly larger than the difference between L2 and L1. The engaging hook 74, when fitted in or pressed in the hole 46, may not move in the sheet conveying direction. A side wall and the protrusion 78 of the engaging hook 74 contact an inner wall of the hole 46. Consequently, the engaging hook 74 fixedly is engaged in the hole 46 with respect to a direction (right-left direction in FIG. 8) perpendicular to the sheet conveying direction.

As shown in FIG. 6, the first guide member 17 may comprise a pair of guide rails 79 and 80 extending horizontally toward the rear of the multi-function device 10. The guide rails 79 and 80 are used to couple the first guide member 17 to the second guide member 18. The guide rails 79 and 80 may have holes 81 and 82 formed therethrough, respectively, which penetrate the guide rails 79 and 80, respectively. As shown in FIGS. 3 and 4, the guide rails 79 and 80 project horizontally from the guide plate 43 when the first guide member 17 is engaged with the guide plate 43.

As shown in FIG. 6, supporting portions 83 and 84 may be formed inside side walls 85 and 86 at both ends in the longitudinal direction of the first guide member 17. The supporting portions 83 and 84 may be grooves which extend in a front to rear direction of the multi-function device 10, and may open toward the rear of the multi-function device 10. The second guide member 18 may be held by the supporting portions 83 and 84, thereby having a position which is fixed with respect to the first guide member 17.

Similar to the first guide member 17, the second guide member 18 may be an elongated member extending in the axial direction of the conveying roller 60. The longitudinal direction of the second guide member 18 is parallel to the axial direction of the conveying roller 60. As shown in FIGS. 3 and 4, the second guide member 18 may be releasably coupled to the first guide member 17 at the upstream of the first guide member 17 in the sheet conveying direction.

As shown in FIGS. 3 and 4, shafts 90 and 91 extend from the longitudinal ends of the second guide member 18, respectively. Although not shown in FIGS. 3 and 4, the shafts 90 and 91 may be supported by a housing of the multi-function device 10, such that the second guide member 18 is pivotable with respect to the housing. FIG. 3 shows a closed position of the second guide member 18, in which the second guide member 18 defines the conveying path 23. FIG. 4 shows an open position of the second guide member 18, in which the conveying path is exposed. The second guide member 18 is pivotable about the shafts 90 and 91 between the closed position and the open position. The second guide member 18 may be coupled to the first guide member 17 when the second guide member 18 is in the closed position, and may be released and separated from the first guide member 17 when the second guide member 18 is in the open position. A back plate 92 of the second guide member 18 comprises a portion of the back surface of the multi-function device 10.

Figure 9:
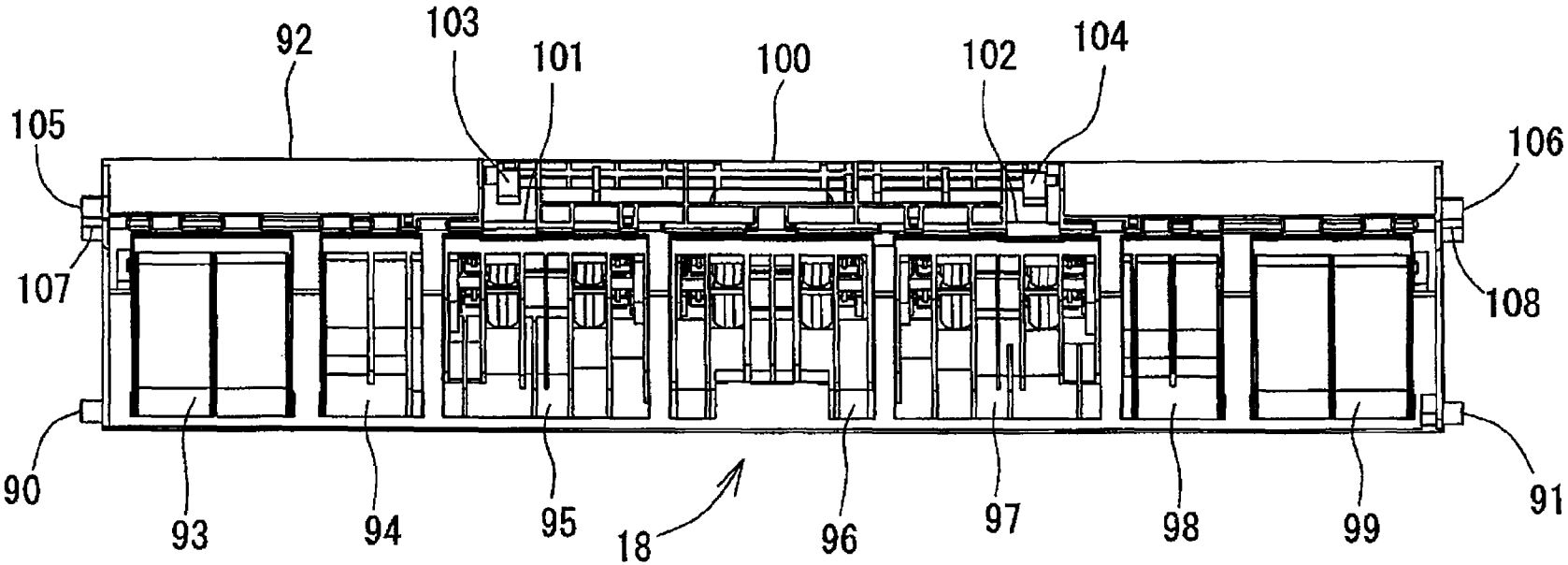
FIG. 9 is a view showing guide members provided on an inner side of a second guide member.

As shown in FIG. 9, the second guide member 18 may comprise guide members 93-99 which face the third guide member 19 when the second guide member 18 is in the closed position. As shown in FIG. 5, the guide members 93-99 are bent in an arc shape. A bent surface defined inside the bent portions of the guide members 93-99 functions as a guide surface for guiding the sheet. The sheet is guided by the guide members 93-99 while being bent along the bent surface defined by the guide members 93-99. The guide members 93-99 may be molded from polyacetal (POM) or other plastics. Ribs extending in the sheet conveying direction may be formed on the guide members 93-99 at predetermined intervals in the longitudinal direction of the second guide member 17. The ribs reduce friction between the guide members 93-99 and the sheet. Moreover, rollers may be provided in the guide members 93-99 so as to further reduce friction.

As shown in FIGS. 4-9, guide grooves 101 and 102 extending in the sheet conveying direction may be formed on an upper surface 100 of the second guide member 18. In FIG. 4, which shows the second guide member 18 in the open position, the upper surface 100 faces toward the rear of the multi-function device 10. The guide grooves 101 and 102 are located at positions and have widths corresponding to the guide rails 79 and 80 of the first guide member 17, respectively. As shown in FIG. 3, when the second guide member 18 is in the closed position, the guide rails 79 and 80 are inserted into the guide grooves 101 and 102, respectively. Consequently, the second guide member 18 is positioned in its longitudinal direction with respect to the first guide member 17.

Lugs 103 and 104 may be positioned on the guide grooves 101 and 102, respectively. When the second guide member 18 changes from the open position to the closed position, the guide rails 79 and 80 of the first guide member 17 are inserted into the guide grooves 101 and 102 of the second guide member 18, respectively, and the lugs 103 and 104 of the guide grooves 101 and 102 engage the holes 81 and 82 in the guide rails 79 and 80, respectively. The second guide member 18 is coupled to the first guide member 17 by the engagement of the lugs 103 and 104 in the holes 81 and 82, and the second guide member 18 is retained in the closed position.

As shown in FIGS. 4 and 9, positioning members 105 and 106 extend laterally (in the longitudinal direction of the second guide member 18) from both ends of a downstream portion of the second guide member 18. As shown in FIG. 9, the positioning members 105 and 106 have bottom surfaces 107 and 108 extending horizontally, respectively. When the second guide member 18 is in the closed position, the positioning members 105 and 106 enter the supporting portions 83 and 84 of the first guide member 17, respectively, and the bottom surfaces 107 and 108 are held by the supporting portions 83 and 84, respectively. Consequently, the bottom surfaces 107 and 108, that is the second guide member 18, is in a fixed position in a downward vertical direction with respect to the first guide member 17.

As shown in FIG. 5, when the second guide member 18 is in the closed position, a downstream portion in the sheet conveying direction of the guide surface of the guide member 96 faces downward. Downstream portions of the guide surfaces of the guide members 93, 94, 95, 96, 97, 99 also face downward. The guide surface 70 of the first guide member 17 extends more downstream than the bent surface of the second guide member 18 and faces downward. The guide surface 70 faces downward substantially in a radial direction of the bent surface defined by the guide members 93-99. When the bottom surfaces 107 and 108 are held by the supporting portions 83 and 84, the downstream portions of the guide members 93-99 are positioned accurately with respect to an upstream portion of the guide surface 70, such that the upstream portion of the guide surface 70 is not projecting inside (downward) in the radius direction of the bent surface beyond the bent surface defined by the guide members 93-99. In this case, the upstream end of the guide surface 70 is positioned outside the downstream end of the second guide member 18 in the radius direction of the bent surface defined by the guide members 93-99.

As shown in FIGS. 4 and 5, the third guide member 19 may be an elongated member extending in the axial direction of the conveying roller 60. The longitudinal direction of the third guide member 19 may be parallel to the axial direction of the conveying roller 60. The third guide member 19 may be assembled to the frame 50 and may be fixed at a predetermined position in the frame 50. The third guide member 19 faces the first guide member 17 and the second guide member 18. A surface of the third guide member 19 that faces the first guide member 17 and the second guide member 17 is a guide member 110. The guide member 110 is bent in an arc shape. Ribs extending in the sheet conveying direction may be formed on the guide surface 110 at predetermined intervals in the longitudinal direction of the third guide member 19. The ribs reduce friction between the guide surface 110 and the sheet.

As shown in FIG. 5, a gap (vertical distance) between the guide surface 70 of the first guide member 17 and the guide surface 110 of the third guide member decreases toward the conveying roller 60. A lead edge of the sheet conveyed in the conveying path 23 is conveyed to a predetermined position of the conveying roller 60 accurately with the aid of the guide surface 70 and the guide surface 110.

As described above, the conveying roller 60 is assembled with precision to the frame 50, and the both ends of the first guide member 17 in the axial direction of the conveying roller 60 are in a fixed position with respect to the conveying roller 40. Furthermore, the middle portion of the first guide member 17 in the axial direction of the conveying roller 60 is in a fixed position with respect to the guide plate 43. Thus, the first guide member 17 is positioned accurately with respect to the conveying roller 60 throughout the axial direction of the conveying roller 60. Consequently, the sheet is conveyed in a stable manner to a predetermined position of the conveying roller 60. In addition, the second guide member 18 is releasably coupled to the first guide member 1 and is changeable between the open position and closed position. Jammed sheets readily may be removed from the conveying path 23 by changing the second guide member 18 to the open position.

The accurate positioning of the first guide 17 with respect to the conveying roller 60 is beneficial especially when the guide members 93-99 of the second guide member 18 define the bent surface along which the sheet is bent while being guided to form a bend, and the second guide member 18 may be positioned outside the bend of the sheet. In this case, the position of a lead edge of the sheet with respect to the conveying roller 60 is likely to be unstable because the sheet is conveyed while the bend of the sheet slides against the guide members 99 outside the bend of the sheet.

The second guide member 18 comprises the positioning members 105 and 106 which position the second guide member 18 with respect to the first guide member 17 in the radius direction of the bent surface of the second guide member 18. The second guide member 18 is coupled to the first guide member 17, such that the upstream portion of the guide surface 70 of the first guide member 17 in the sheet conveying direction is not projecting inside beyond the downstream ends of the guide members 93-99 in the radius direction of the bent surface of the second guide member 18. The upstream portion of the guide surface 70 is not projecting with respect to the guide members 93-99 in a direction to cross the sheet conveying direction. Accordingly, even when the second guide member 18 is pivoted repeatedly, paper jamming is unlikely to occur in the joints between the first guide member 17 and the second guide member 18.

In addition, the engaging hooks 73 and 76 provided adjacent to the ends of the first guide member 17, respectively, engage the holes 45 and 48, respectively, and may move slightly within holes 45 and 48, respectively. Thus, the positioning of the first guide member 17, on its both ends in the axial direction of the conveying roller 60, with respect to the conveying roller 60 may receive a higher priority than the positioning of the first guide member 17, on its both ends in the axial direction of the conveying roller 60, with respect to the guide plate 43.

The middle portion of the first guide member 17 is positioned to the guide plate 43. The guide plate 43 may be relatively flat and is positioned accurately to the frame body 51, such that the carriage 38 to which the recording head 39 is mounted slides on the guide plate 43 horizontally with precision. Because the middle portion of the first guide member 17 is in a fixed position with respect to the guide plate 43, the sheet is guided accurately by the first guide member 17 to the predetermined position of the conveying roller 60.

While the invention has been described in connection with exemplary embodiments, it will be understood by those skilled in the art that other variations and modifications of the exemplary embodiments described above may be made without departing from the scope of the invention. Other embodiments will be apparent to those skilled in the art from a consideration of the specification or practice of the invention disclosed herein. It is intended that the specification and the described examples are considered merely as exemplary of the invention, with the true scope of the invention being indicated by the following claims.

What is claimed is:

1. An image recording device comprising:

a recording head configured to eject ink onto a recording medium;

a carriage configured to carry the recording head and to reciprocate in a reciprocating direction;

a conveying roller extending in an axial direction parallel to the reciprocating direction and configured to convey the recording medium to the recording unit, wherein the conveying roller comprises engaged portions formed at both end portions thereof in the axial direction;

a frame configured to rotatably support the conveying roller and comprising a plate which extends in the axial direction and is separated from the conveying roller by a predetermined distance, wherein the plate supports the carriage and comprises at least one engaged portion; and a particular guide member extending in the axial direction and configured to guide the recording medium toward the conveying roller, wherein the particular guide member comprises end engaging portions formed at both end portions thereof in the axial direction and at least one middle engaging portion formed between the end engaging portions in the axial direction; and wherein the end engaging portions of the particular guide member are engaged with the engaged portions of the conveying roller respectively, and the at least one middle engaging portion of the particular guide member is engaged with the at least one engaged portion of the plate on which the carriage reciprocally slides.

2. The image recording device of claim 1, further comprising:

a further guide member releasably coupled to the particular guide member at a position upstream of the particular guide member in a recording medium conveying direction.

3. The image recording device of claim 2, wherein the further guide member is pivotable with respect to the particular guide member between a first position in which the further guide member is coupled to the particular guide member, and a second position in which the further guide member is separated from the particular guide member.

4. The image recording device of claim 3, wherein the further guide member comprises an engaging portion, and the particular guide member comprises an engaged portion, wherein the engaging portion is configured to engage the engaged portion to maintain the further guide member in the first position.

5. The image recording device of claim 1, wherein the conveying roller comprises a first bearing fitted freely around one of the both end portions thereof, and a second bearing fitted freely around the other of the both end portions, and wherein each of the end engaging portions of the particular guide member is engaged with a corresponding one of the first bearing and the second bearing.

6. The image recording device of claim 5, wherein the end engaging portions of the particular guide member comprise a first C-shaped hook having a first opening and a second C-shaped hook having a second opening, and wherein the first bearing is fitted in the first opening and the second bearing is fitted in the second opening.

7. The image recording device of claim 2, wherein the further guide member comprises a bent surface along which the recording medium is bent while being guided to form a bend.

8. The image recording device of claim 7, wherein the particular guide member and the further guide member are positioned outside the bend of the recording medium being guided.

9. The image recording device of claim 7, further comprising a specific guide member fixed to the frame at a position inside the bent surface of the further guide member in a radius direction of the further guide member, wherein the specific guide member comprises a guide surface facing the particular guide member and the further guide member, wherein a gap between the particular guide member and the specific guide member decreases toward the conveying roller.

10. The image recording device of claim 7, wherein the further guide member comprises a plurality of positioning members configured to position the bent surface of the further guide member in a radius direction of the bent surface with respect to the particular guide member.

11. The image recording device of claim 10, wherein the particular guide member comprises a guide surface extending more downstream than the bent surface of the further guide member in the recording medium conveying direction, and the positioning members of the further guide member position the bent surface of the further guide member such that an upstream portion of the guide surface of the particular guide member is not projecting inside, in the radius direction of the bent surface, beyond the bent surface of the further guide member.

12. The image recording device of claim 10, wherein the positioning members are positioned at both ends of the further guide member in the axial direction, the particular guide member comprises at both ends thereof in the axial direction supporting portions, and the supporting portions of the particular guide member receive the positioning members of the further guide member when the further guide member is coupled to the particular guide member.

13. The image recording device of claim 1, wherein the at least one middle engaging portion of the particular guide member comprises a first middle engaging portion and a second middle engaging portion which is positioned closer to a center of the particular guide member in the axial direction than the first middle engaging portion, and wherein the at least one engaged portion of the plate comprises a plurality of engaged portions arranged in the axial direction, and wherein the first middle engaging portion is movably engaged with a corresponding one of the plurality of engaged portions.

14. The image recording device of claim 13, wherein the second middle engaging portion is fixedly engaged with a corresponding one of the plurality of engaged portions of the plate.

15. The image recording device of claim 1, wherein the at least one middle engaging portion of the particular guide member comprises a plurality of engaging hooks, and the plate has, as the at least one engaed portions, a plurality of holes formed therethrough, and wherein each of the plurality of engaging hooks is engaged with a corresponding one of the plurality of holes of the plate.

16. The image recording device of claim 1, wherein the plate of the frame comprises a first surface and a second surface opposite to the first surface, and the carriage reciprocally slides on the first surface of the plate and the particular guide member is coupled to the second surface of the plate.

17. An image recording device comprising:

a recording head configured to eject ink onto a recording medium;

a carriage configured to carry the recording head and to reciprocate in a reciprocating direction;

a conveying roller extending in an axial direction parallel to the reciprocating direction and configured to convey the recording medium to the recording unit;

a frame configured to rotatably support the conveying roller;

a plate extending in the axial direction and configured to support the carriage such that the carriage reciprocally slides on the plate; and a guide member extending in the axial direction and configured to guide the recording medium toward the conveying roller, wherein the guide member is coupled to the plate on which the carriage reciprocally slides.

18. The image recording device of claim 17, wherein the plate of the frame comprises a first surface and a second surface opposite to the first surface, and the carriage reciprocally slides on the first surface of the plate and the guide member is coupled to the second surface of the plate.

* * * * *